US005425654A

United States Patent [19]

Colleran et al.

[11] Patent Number: 5,425,654

[45] Date of Patent: Jun. 20, 1995

[54] ELECTRICAL CONNECTOR ASSEMBLY WITH CAM LEVER LOCK MECHANISM

[75] Inventors: Stephen A. Colleran, Lisle; Bill B. Wilson, Montgomery, both of Ill.

[73] Assignee: Molex Incorporated, Lisle, Ill.

[21] Appl. No.: 132,018

[22] Filed: Oct. 5, 1993

[51] Int. Cl.[6] ..... H01R 13/62

[52] U.S. Cl. ..... 439/372; 439/153

[58] Field of Search ..... 439/152–160, 439/372, 341, 347

[56] References Cited

U.S. PATENT DOCUMENTS

| | | | |
|---|---|---|---|
| 2,228,646 | 1/1941 | Summers | 439/157 |
| 2,609,268 | 9/1952 | Nye | 439/372 |
| 2,799,009 | 7/1957 | Benander | 439/372 |
| 3,065,441 | 11/1962 | Leonard | 439/153 |
| 3,209,303 | 9/1965 | Uberbacher | 439/155 |
| 5,035,634 | 7/1991 | Hasircoglu et al. | 439/157 |
| 5,135,410 | 8/1992 | Kawase et al. | 439/372 |
| 5,174,785 | 12/1992 | Endo et al. | 439/489 |
| 5,230,635 | 7/1993 | Takenouchi et al. | 439/157 |

FOREIGN PATENT DOCUMENTS

| | | | |
|---|---|---|---|
| 0929570 | 6/1963 | United Kingdom | 439/155 |

*Primary Examiner*—David L. Pirlot
*Attorney, Agent, or Firm*—A. A. Tirva

[57] ABSTRACT

A cam lever locking mechanism is provided for an electrical connector assembly which includes a lever pivotally mounted on a first connector. The lever has an eccentric cam for engaging a cam follower on a second connector for providing a mechanical advantage while mating the connectors on a mating axis generally centrally of the connectors, in response to rotation of the lever. The lever is rotatable about a pivot axis transverse to and generally intersecting the mating axis of the connectors. The eccentric cam on the lever is aligned generally with the mating axis of the connectors. The cam follower on the second connector is located generally on the mating axis.

5 Claims, 4 Drawing Sheets

ELECTRICAL CONNECTOR ASSEMBLY WITH CAM LEVER LOCK MECHANISM

FIELD OF THE INVENTION

This invention generally relates to the art of electrical connectors and, particularly, to a cam lever mechanism for mating and unmating a pair of connectors or a connector and another part.

BACKGROUND OF THE INVENTION

Electrical connectors are used in a variety of applications for making large numbers of electrical interconnections. A connector typically includes two components: a housing or other body member and a plurality of terminals or electrical contact elements mounted on the housing. A connector may be attached to the end of a multi-conductor cable, and a second connector may be mechanically and electrically interconnected to a printed circuit or wiring board, or both connectors may be attached to cables or both connectors may be interconnected to a pair of boards. Regardless of the application, electrical connectors often are difficult to mate or interconnect when they mount a large number of terminals. In addition, some connector assemblies may be sealed assemblies, with the seal means making it difficult to mate the connectors.

Consequently, a variety of devices have been designed for assisting the mating process. One typical device or mechanism is a cam lever mechanism, such as those shown in U.S. Pat. Nos. 5,035,634 to Hasircoglu et al, dated Jul. 30, 1991; 5,135,410 to Kawase et al, dated Aug. 4, 1992; 5,174,785 to Endo et al, dated Dec. 29, 1992; and 5,230,635 to Takenouchi et al, dated Jul. 27, 1993.

All of the above-referenced patents show examples of cam lever mechanisms of the prior art, wherein mating connectors are provided with levers having camming surfaces, the lever being mounted on one of the mating connectors such that a camming surface engages a projection located on the outside of the second mating connector. The projection defines a cam follower and usually projects laterally outwardly from the outside of the connector housing. Since the lever and the housing usually is molded from plastic, the laterally extending projection often is not strong enough to withstand the necessary high mating and unmating forces between the connectors. In addition, many such cam lever mechanisms require two hands or a special tool to operate or are very difficult to operate with a single hand. Still further, with many of the prior art cam lever mechanisms, the cam follower projections are located on the outside of the connector housings or somewhere remote from the central mating axis of the connector assembly. This causes binding between the connectors during mating and unmating, particularly with connector assemblies involving large numbers of terminals. Additionally, prior art cam lever mechanisms are next to impossible to use in sealed connector assemblies because of the larger forces required and a substantially large increase in the envelope size of the connector.

This invention is directed to solving the myriad of problems identified above and also satisfying a need for a simple yet very effective cam lever mechanism in comparison to the prior art.

SUMMARY OF THE INVENTION

An object, therefore, of the invention is to provide a new and improved electrical connector assembly with a novel cam lever locking mechanism.

In the exemplary embodiment of the invention, the electrical connector assembly generally includes a lever pivotally mounted on a first connector, the lever having cam means for engaging a cam follower on a second connector. The cam follower and the cam means on the lever provide a mechanical advantage while mating the connectors on a mating axis generally centrally of the connectors. The lever is rotatable about a pivot axis transverse to and generally intersecting the mating axis. The invention contemplates that the cam means on the lever as well as the cam follower on the second connector be located generally on the central mating axis of the connectors.

In the preferred embodiment of the invention, the cam follower, generally, is defined by a projection extending from the second connector toward the first connector. Specifically, the projection is provided by an elongate rod having cam follower means on a distal end thereof. The connectors have opposing faces defining a mating interface of the connector assembly. The rod extends through the interface. An opposite end of the rod is connected to an outside portion of the second connector remote from its mating face. Still further, the cam follower means in the disclosed embodiment comprises a groove in the distal end of the rod, and the lever has an eccentric rib slidable in the groove.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
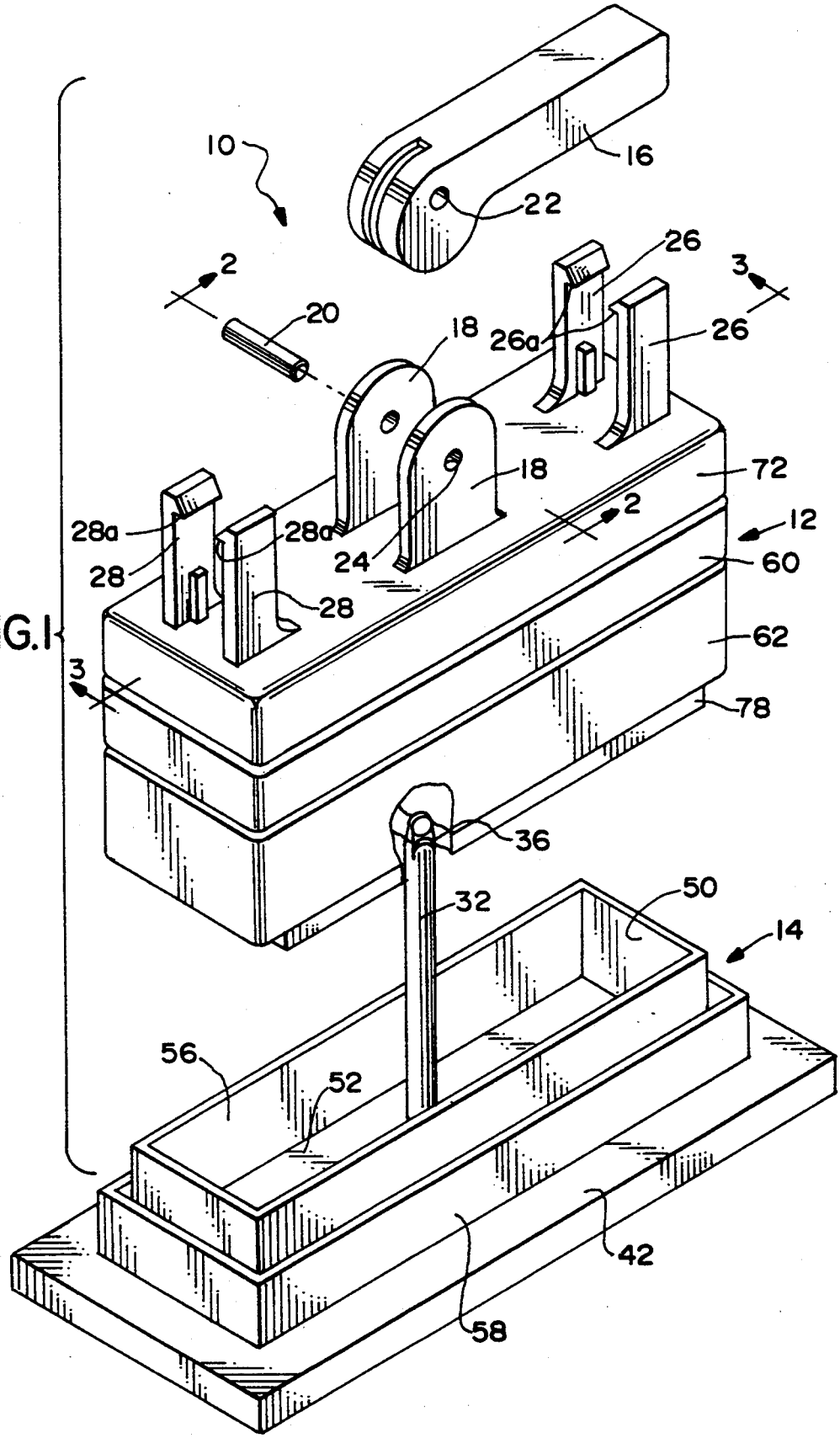
FIG. 1 is an exploded perspective view of an electrical connector assembly embodying the concepts of the invention.

Referring to the drawings in greater detail, and first to FIG. 1, the invention is embodied in an electrical connector assembly, generally designated 10, which includes a first connector, generally designated 12, and a second connector, generally designated 14. The second connector is illustrated as a header connector for mounting on a surface of a printed circuit board (not shown). It should be understood that, although the invention is illustrated herein as embodied in a connector assembly which includes first and second mateable connectors, the invention equally is applicable for mating a single connector to another part, such as a circuit panel or any variety of mateable components.

Still referring to FIG. 1, a lever 16 is pivotally mounted between a pair of ears 18 projecting upwardly from first connector 12, by means of a pivot connection which includes a pivot pin 20 which projects through aperture means 22 in lever 16 and holes 24 in ears 18. Two pairs of latch arms 26 and 28 project upwardly from first connector 12, the latch arms having latch hooks **26*a* and 28*a*, respectively, directed inwardly in an opposing manner. Latch arms 26 and 28, and particularly latch hooks 26*a* and 28*a*, define unmated and mated positions for lever 16**, 180° apart, as will be more apparent hereinafter.

Figure 2:
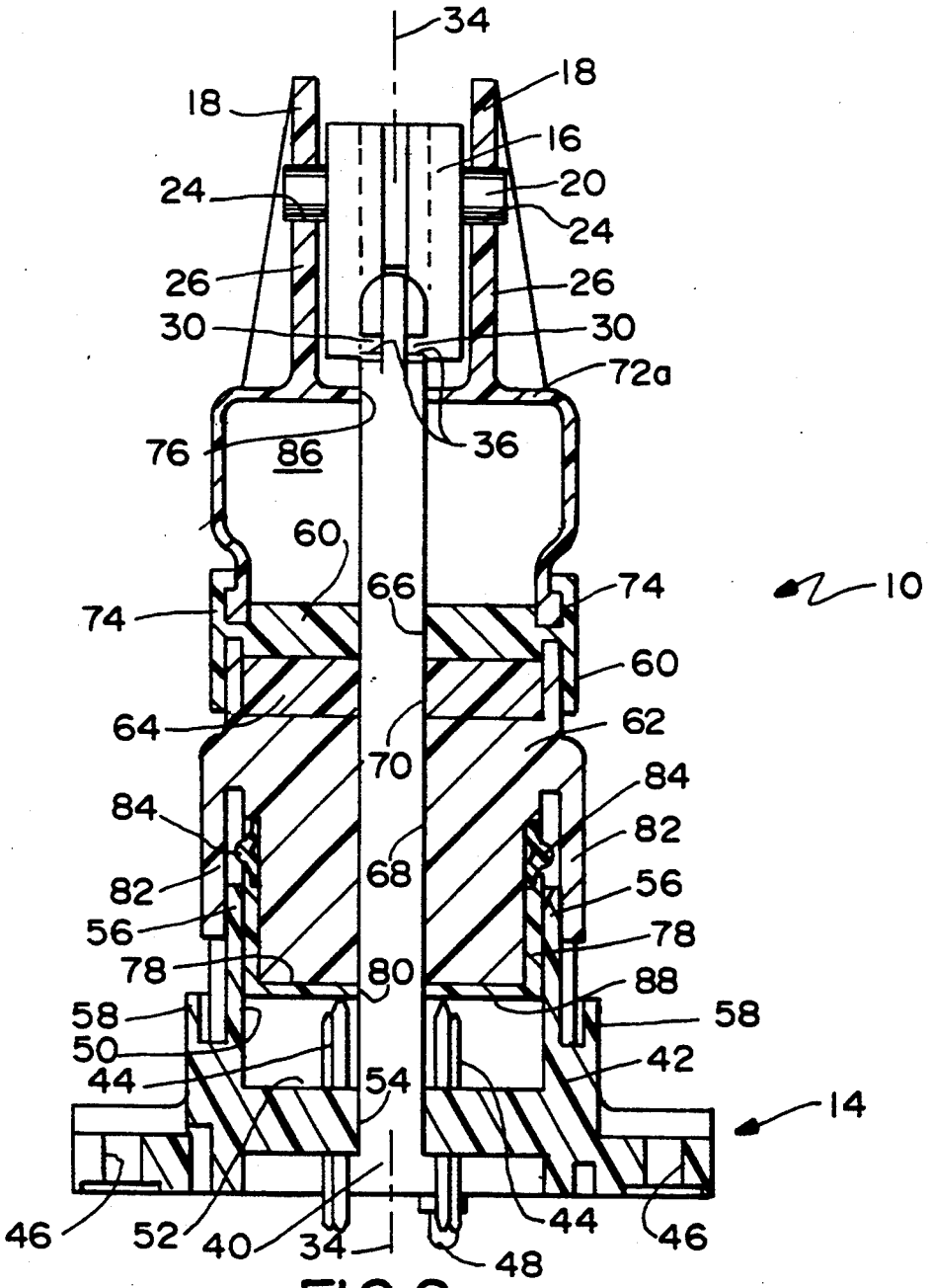
FIG. 2 is a vertical section taken generally along line 2—2 of FIG. 1, with the connector assembly in its assembled but pre-mated condition.
Figure 3:
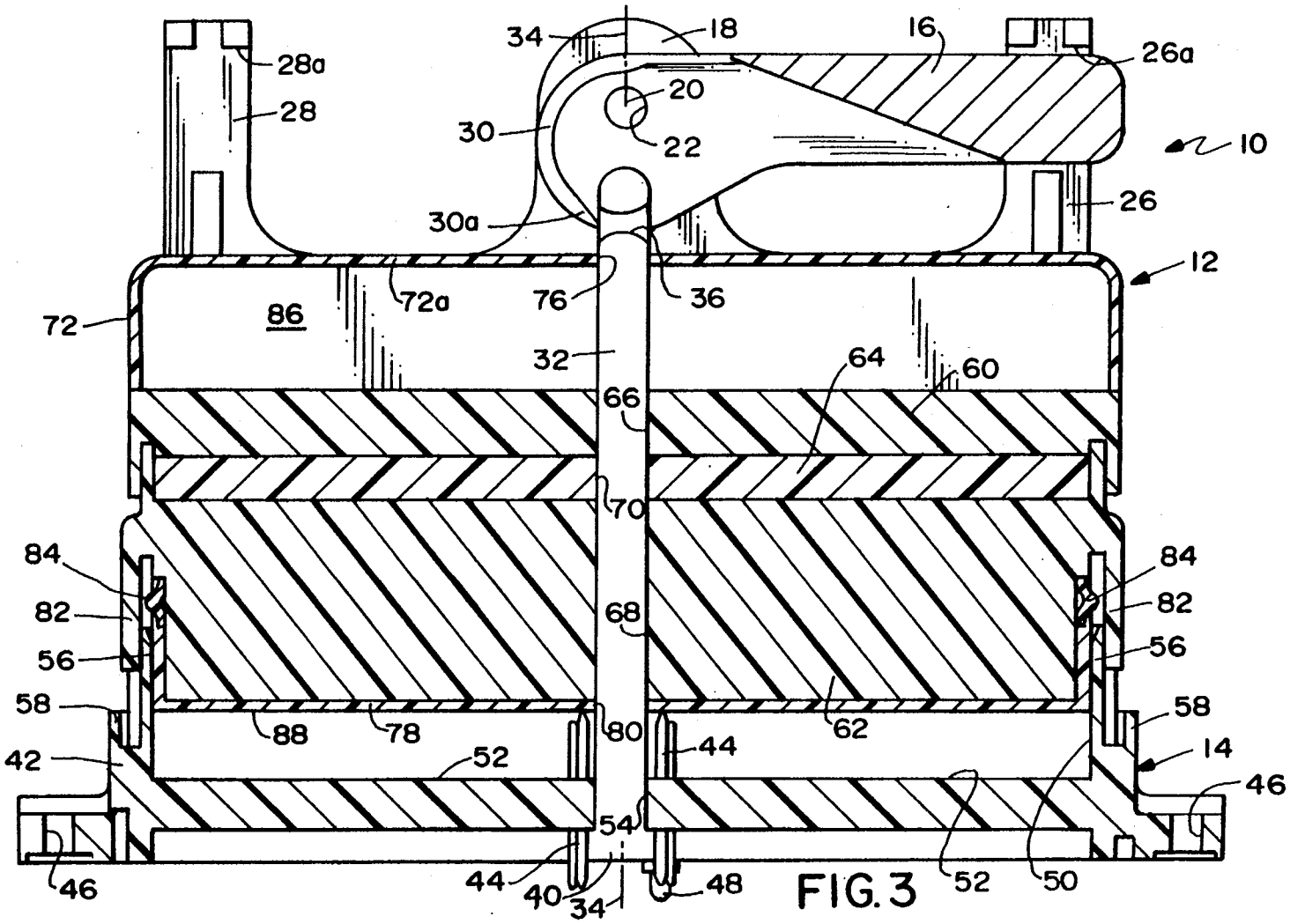
FIG. 3 is a vertical section similar to that of FIG. 2, but taken generally along line 3—3 of FIG. 1.

Referring to FIGS. 2 and 3 in conjunction with FIG. 1, generally, lever 16 has cam means 30 (FIG. 3) for engaging a cam follower 32 on second connector 14 for providing a mechanical advantage while mating the connectors on a mating axis 34 generally centrally of the connector assembly, in response to rotation of the lever. The cam follower is provided by a rod which projects from second connector 14 toward first connector 12. A cam follower means are provided on a distal end of rod 32, in the form of grooves 36 on opposite sides of the rod. Cam means 30 are provided by a pair of arcuate ribs inside lever 16, the arcuate ribs being eccentric about pivot pin 20 which defines the pivot axis of the lever. As will be described in greater detail below, rod 32 extends entirely through the pair of mating connectors, with an opposite end 40 of the rod being T-shaped to provide a connection on the outside/bottom of second connector 14 remote from the mating interface of the two connectors.

More particularly, referring specifically to FIGS. 2 and 3 in conjunction with FIG. 1, second connector 14 essentially is provided by a unitarily molded plastic housing 42 which mounts a plurality of terminal pins 44 as is fairly conventional with header connectors. The terminal pins project below housing 42 for insertion into appropriate holes in a printed circuit board, whereby the bottom ends of the pins form solder tails for solder connection to appropriate circuit traces on the board and/or in the holes. Housing 42 may include a plurality of apertures 46 through which appropriate fastening means can be inserted to secure second connector 14 to the printed circuit board. One or more locating or mounting pegs 48 may be provided to facilitate mounting the connector to the circuit board. The upper portion of housing 42 of second connector 14 includes a receptacle 50 having a bottom wall 52. Rod 32 projects upwardly through a hole 54 in housing 42 on mating axis 34. Receptacle 50 is defined by a peripheral wall 56 which, in turn, is surrounded by another peripheral wall 58 spaced from wall 56, for purposes described hereinafter.

As best seen in FIGS. 2 and 3, first connector 12 is a multi-component connector having an upper housing part 60 and a lower housing part 62 sandwiching a seal 64 therebetween. Rod 32 extends through bores 66 and 68 in housing parts 60 and 62, respectively, as well as through a hole 70 in seal 64, whereby the seal sealingly surrounds the rod. An upper shroud 72 is snappingly engaged with upper housing part 60, as at 74 in FIG. 2, and latch arms 26 project upwardly from a top wall **72*a* of the shroud. Rod 32 projects through a hole 76 in top wall 72*a*. A sealing boot 78 surrounds the bottom of lower housing part 62, and rod 32 projects through a hole 80 in the sealing boot. Lower housing part 62 has an outer peripheral lip 82 which is shaped to conform with and surround wall 56 of second connector 14, with wall 56 being sandwiched between lip 82 and sealing boot 78. Still another seal means, in the form of an "O" ring seal 84, surrounds lower housing part 62 for engaging the inside of wall 56** of the second connector.

It should be understood that first connector 12 mounts a relatively large number of female terminals or contacts which interconnect with terminal pins 44 of the second or header connector 14, as is well known in the art. The female terminals are not shown in the drawings in order to avoid cluttering the depictions. Normally, each female terminal will have a mating socket at one end for receiving one of the terminal pins 44, and an opposite terminating end will be terminated to a single conductor of a multi-conductor cable which extends into an open area 86 between shroud 72 and upper housing part 60.

From the above description, it can be understood that, with rod 32 being located on central mating axis 34 of the connector assembly, the rod extends directly through the mating interface of the assembly. For instance, the interface may be defined by opposing faces such as the bottom wall 52 of receptacle 50 of second connector 14 and the opposing surface 88 of sealing boot 78 of first connector 12. Therefore, the mating and unmating forces effected by pivoting lever 16 are on the mating axis of the connector assembly, rather than the sides of the assembly as is prevalent with the prior art. Consequently, the centralized forces substantially prevent binding between the two connectors during mating and unmating thereof.

Figure 4:
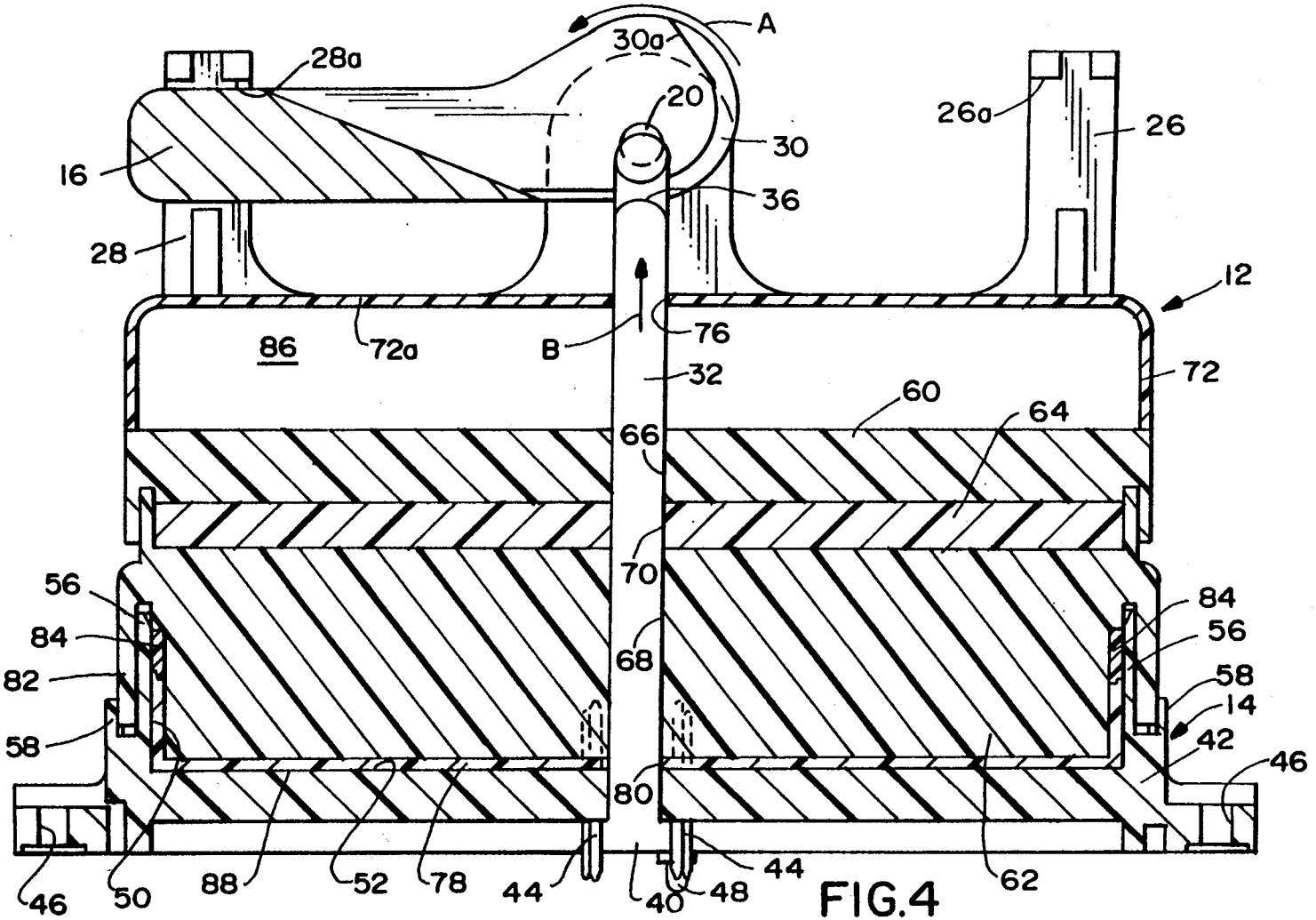
FIG. 4 is a view similar to that of FIG. 3, with the connector assembly in its fully mated condition.

In operation, connector assembly 10 is shown in FIGS. 2 and 3 in an assembled but pre-mated condition of connectors 12 and 14. In other words, a clear separation can be seen between the bottom of sealing boot 78 of the first connector and the bottom wall 52 of receptacle 50 of the second connector. In this condition, it can be seen that lever 16 is located between latch arms 26 and beneath latch hooks **26*a* of the latch arms. When it is desired to mate the connectors, lever 16 is rotated in the direction of arrow "A" (FIG. 4), approximately 180° to a position shown in FIG. 4. The lever snaps beneath latch hooks 28*a* of latch arms 28. As the lever rotates from the position of FIGS. 2 and 3 to the position of FIG. 4, tapered ends 30*a* of eccentric cam ribs 30 on the lever enter cam follower grooves 36 on opposite sides of the distal end of rod 32. Continued rotation of the lever pulls upwardly on the rod in the direction of arrow "B" (FIG. 4) in the context of relative movement between the rod and the lever. This action is effective to force the connectors together to a mated condition as shown in FIG. 4. Of course, the movement is relative. In other words, if second connector 14 is secured to a fixed circuit board, with remote end 40 of rod 32 fixed beneath the second connector, as lever 16 is rotated as described above, the upper or first connector 12 will be forced downwardly into mating condition with the header connector in response to rotation of lever 16 and the sliding movement of eccentric cam ribs 30 in cam follower grooves 36 at the upper distal end of rod 32**.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In an electrical connector assembly which includes a lever pivotally mounted on a first connector, the lever having cam means for engaging a cam follower on a second connector for providing a mechanical advantage while mating and unmating the connectors on a mating axis generally centrally of the conductors in response to rotation of the lever, said lever being rotatable about a pivot axis transverse to and generally intersecting the mating axis of the connectors, wherein the improvement comprises:

said cam means of the lever being in general alignment with the mating axis of the connectors, said cam follower being located generally on said mating axis, and wherein said cam follower comprises a rod extending from the second connector toward the first connector having cam follower means on a distal end thereof;

wherein said cam follower means comprise a groove in the distal end of the rod, and the lever has an eccentric rib slidable in the groove.

2. In an electrical connector assembly as set forth in claim 1, wherein said connectors have opposing faces defining a mating interface of the connector assembly, and said rod extends through the interface.

3. In an electrical connector assembly as set forth in claim 2, including means connecting an opposite end of the rod to an outside portion of the second connector remote from its mating face.

4. A cam lever locking mechanism for an electrical connector assembly, comprising:

first and second mating connectors which are mateable on an axis generally centrally of a mating interface of the connector assembly;

a lever pivotally mounted on the first connector for rotation about a pivot axis transverse to and generally intersecting the mating axis of the connectors, the lever having cam means generally in alignment on the mating axis; and a cam follower means on the second connector for providing a mechanical advantage while mating and unmating the connectors in response to rotation of the lever, the cam follower means being on a distal end of an elongate rod located generally on said mating axis and extending through the mating interface of the connector assembly wherein said cam follower means comprise a groove in the distal end of the rod, and the lever has an eccentric rib slidable in the groove.

5. The cam lever locking mechanism of claim 4, including means connecting an opposite end of the rod to an outside portion of the second connector remote from its mating face.

* * * * *